US007080733B2

(12) United States Patent
Kao

(10) Patent No.: US 7,080,733 B2
(45) Date of Patent: Jul. 25, 2006

(54) TOOL SUSPENSION PLATE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 10/702,644

(22) Filed: Nov. 7, 2003

(65) Prior Publication Data

US 2005/0098461 A1 May 12, 2005

(51) Int. Cl.
*B65D 85/20* (2006.01)
*A47F 7/00* (2006.01)

(52) U.S. Cl. ..... 206/372; 206/565; 211/70.6

(58) Field of Classification Search ..... 206/349, 206/372, 373, 376, 378, 565; 211/70.6
See application file for complete search history.

(56) References Cited

U.S. PATENT DOCUMENTS 5,515,969 A * 5/1996 Schonenbach ..... 206/373
5,941,386 A * 8/1999 Hu et al. ..... 206/376
5,967,340 A * 10/1999 Kao ..... 211/70.6
5,988,382 A * 11/1999 Ritchie et al. ..... 206/372
6,131,740 A * 10/2000 Huang ..... 206/759
D433,613 S * 11/2000 Jialin ..... D8/71
6,536,611 B1 * 3/2003 Chen ..... 211/70.6

* cited by examiner

*Primary Examiner*—Jila M. Mohandesi
(74) *Attorney, Agent, or Firm*—Lowe Hauptman & Berner, LLP

(57) ABSTRACT

A tool suspension plate has a base, at last one fastening device formed on the base, and a slat detachably mounted on the base to cross over the at least one fastening device and to secure at least one screwdriver on the base. Each fastening device has a clamping element adapted to clamp a part of a screwdriver and a supporting element adapted to support a handle of the screwdriver. Thereby, the screwdriver is firmly secured on the tool suspension plate. Furthermore, by in cooperation with the slat, the tool suspension plate has excellent thief-proof, displaying and retaining effects.

12 Claims, 13 Drawing Sheets

TOOL SUSPENSION PLATE

BACKGROUND OF THE INVENTION

1. Field of the Invention

The present invention relates to a tool suspension plate, and more particularly a tool suspension plate adapted to hold and display screwdrivers 2. Description of Related Art With reference to FIGS. 10 and 11, a conventional tool suspension rack is adapted to hold a wrench (80) and comprises a suspension plate (70) with a bottom and a bracket (72) detachably secured on the suspension plate (70). Two slits (701) are defined in the suspension plate (70) respectively at two sides near the bottom and two first apertures (702) are defined in the suspension plate (70) close to the slits (701). The bracket (72) is a U-shaped frame with a recess (not numbered) and has two connecting protrusions (721) formed on two oppositely distal ends of the bracket (72) to abut on the suspension plate (70). Each connecting protrusion (721) has a hook (722) correspondingly and detachably engaged with one corresponding slit (701) of the suspension plate (70). Each connecting protrusion (721) further has a second aperture (723) aligning with the first aperture (702). Thereby, a locking pin (74) is enabled to penetrate the first and second apertures (702,723) to fasten the bracket (72) and the suspension plate (70) together.

The wrench (80) is held on the tool suspension rack by resting a first head end of the tool on the bracket (72) via the recess and usually has a second head end connected by a slender handle to the first head end (not shown) that avoids the wrench (80) from being pulled upward to escape from the tool suspension rack. Therefore, once the locking pins (74) are attached on the bracket (74) and the suspension plate (70), the wrench (80) is not detachable to prevent shoplifting. However, the retailer can remove the locking pins (74) to allow a customer to inspect the wrench prior to purchase. However, for other tools without two large ends separated by a slender portion, such as screwdriver, it is not suitable to use such kind of tool suspension rack. This is because although the screwdriver has a large handle at one end that can rest on the bracket it has only a straight shaft formed at the other end that means the screwdriver can exit through the recess. Therefore, the screwdriver is easily stolen from the tool suspension rack.

Additionally, when a screwdriver is mounted on the conventional tool suspension rack, the straight shaft extending out of the bracket (72) swings too easily on the rack, such as when someone passes by, and the screwdriver may scratch and lever against surrounding objects. Therefore, the conventional suspension rack is easily broken at joints between the bracket (72) and the suspension plate (70) when a screwdriver is fitted in it.

In order to make a suitable tool suspension structure for screwdrivers, the present invention provides a tool suspension plate to conveniently retain and display a screwdriver set.

SUMMARY OF THE INVENTION

A main objective of the invention is to provide a tool suspension plate for screwdrivers that has theft-proof, displaying, and retaining effects.

Other objects, advantages and novel features of the invention will become more apparent from the following detailed description when taken in conjunction with the accompanying drawings.

DETAILED DESCRIPTION OF THE PREFERRED EMBODIMENT

The tool suspension plate in accordance with the present invention comprises a base, at least one clamping element, at least one supporting element, and a slat detachably mounted on the plate and crossing at least one screwdriver to provide a thief-proof efficiency. Because each clamping element and each supporting element have versatile modifications in shapes and positions, two preferred embodiments are illustrated as the following.

Figure 1:
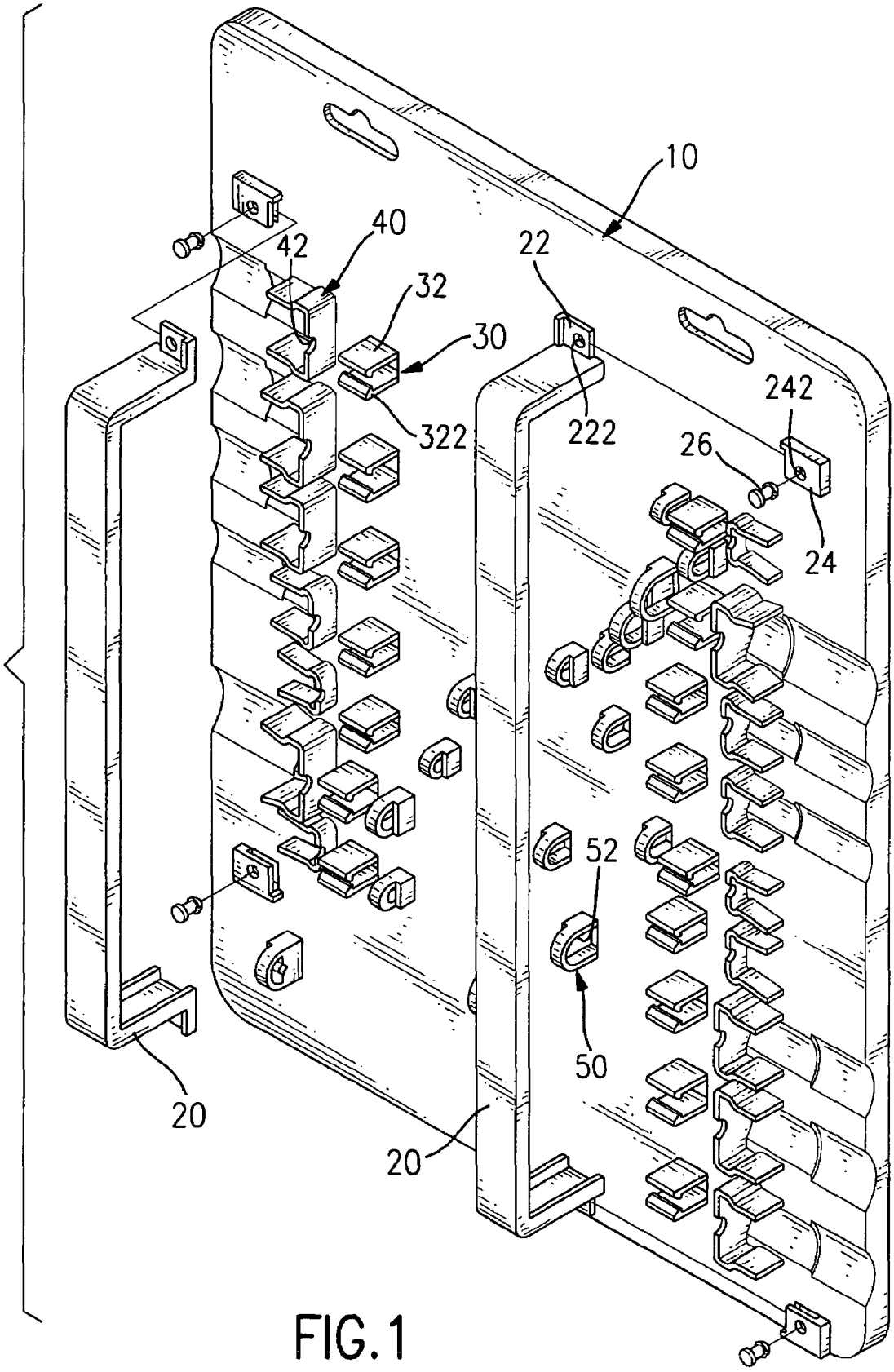
FIG. 1 is an exploded perspective view of a first embodiment of a tool suspension plate in accordance with the present invention.
Figure 2:
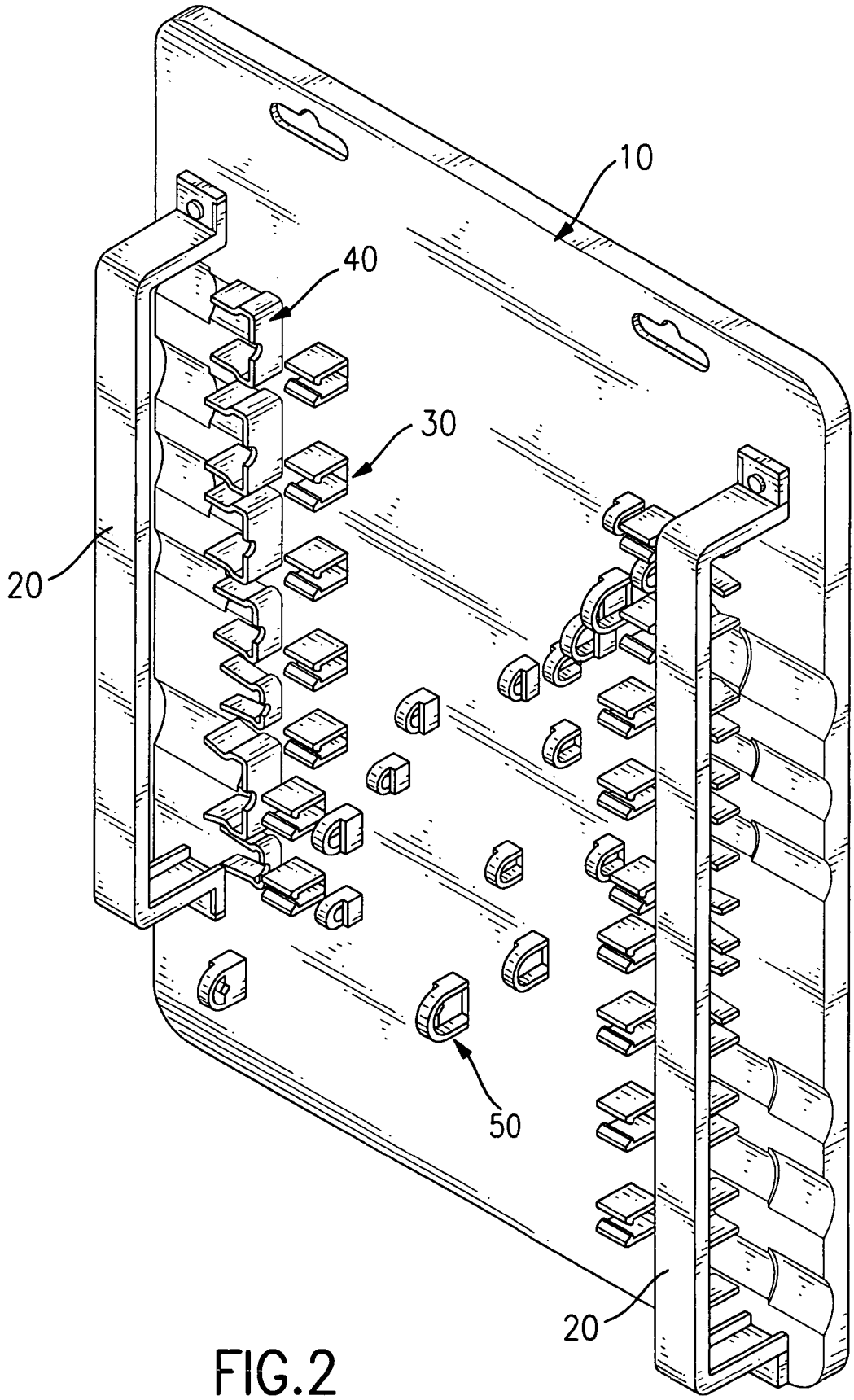
FIG. 2 is a perspective view of the tool suspension plate in accordance with FIG. 1, wherein the tool suspension plate is assembled.
Figure 3:
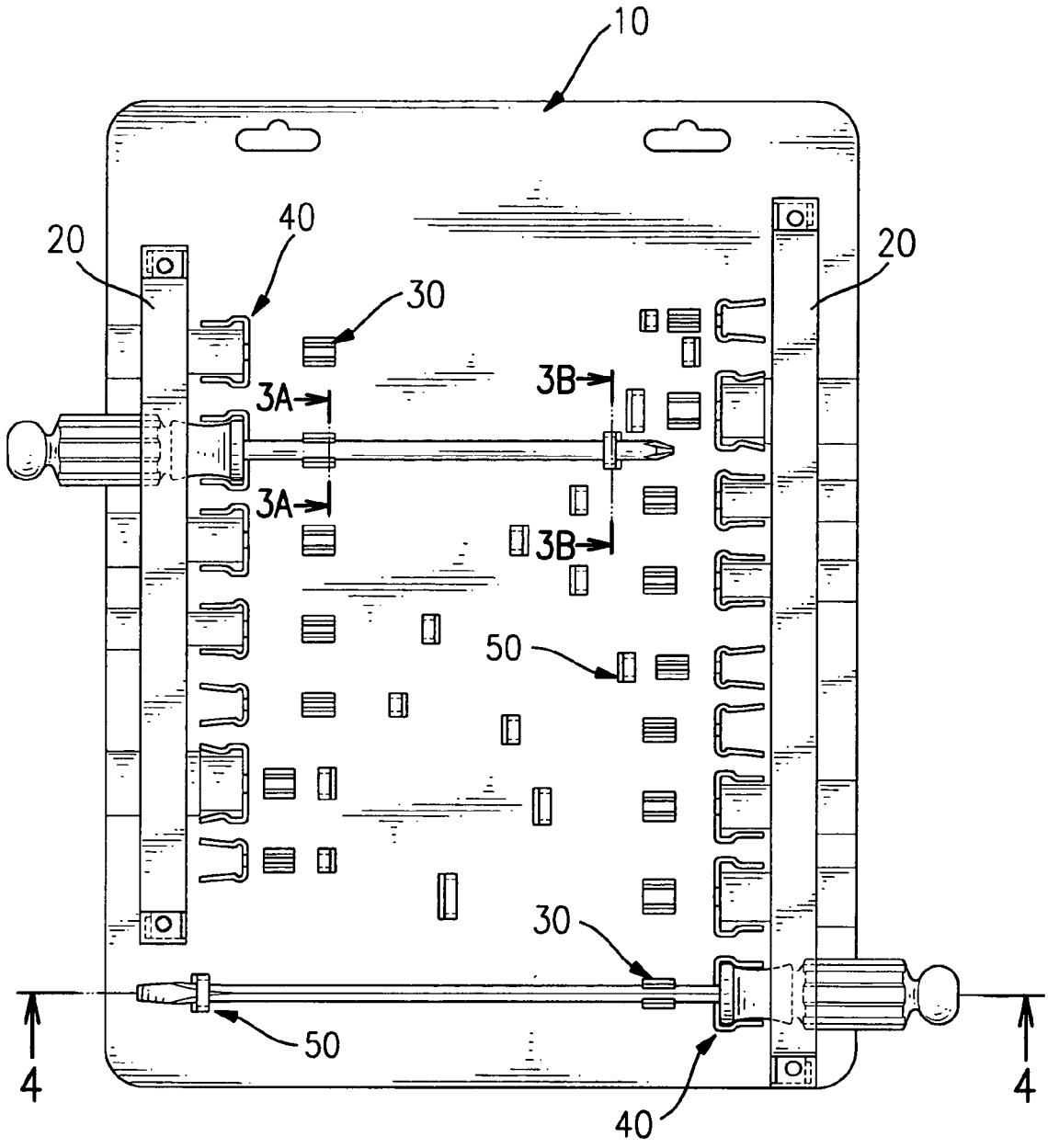
FIG. 3 is a top plane view of the tool suspension plate in accordance with FIG. 1, wherein screwdrivers are mounted on the tool suspension plate.

With reference to FIGS. 1 and 3, a first embodiment of tool suspension plate has a screwdriver set placed horizontally and arranged one by one in a vertical direction. The first embodiment of the tool suspension plate comprises a base (10), multiple fastening devices (not numbered) formed on the base (10), and a slat (20) detachably mounted on the base (10) and crossing the multiple fastening devices.

The base (10) is a rectangular plate with a top and has two suspension holes (12) defined in the plate to suspend the base (10) on a desired place by means of hook.

Figure 3B:
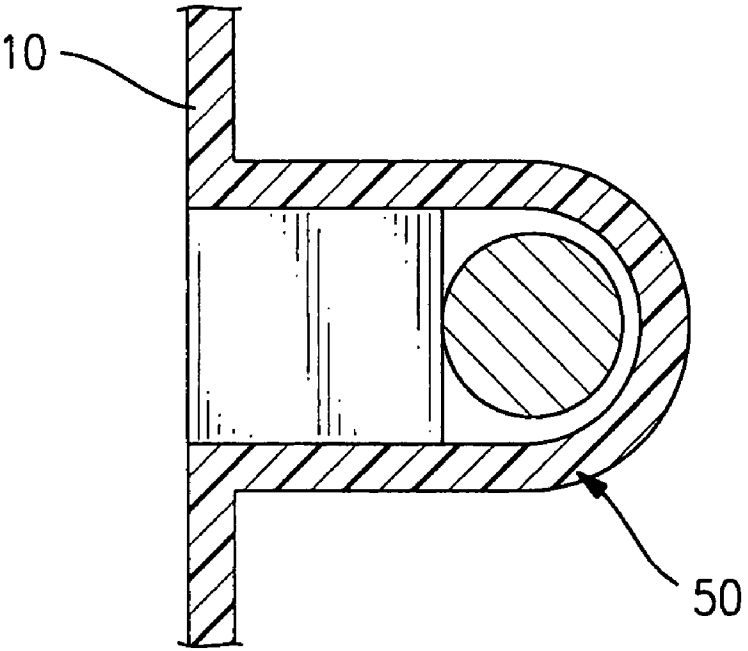
FIG. 3B is a cross-sectional side plane view of a loop along line 3B—3B in FIG. 3.
Figure 3A:
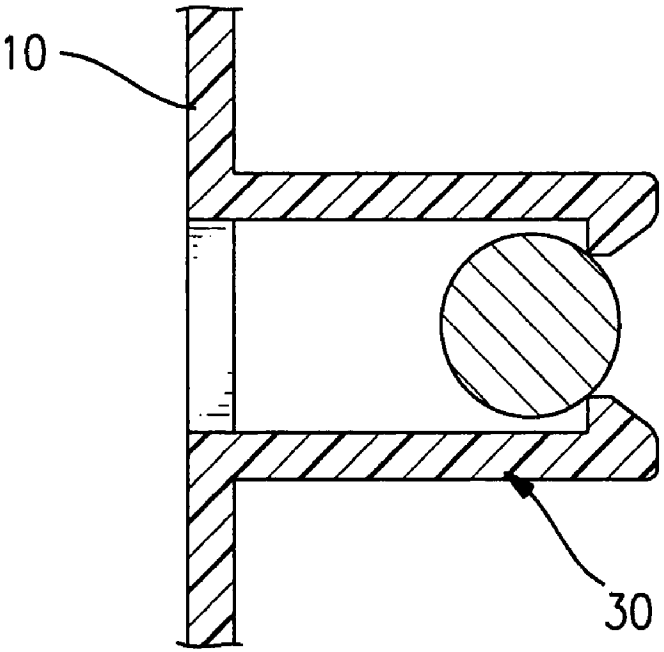
FIG. 3A is a cross-sectional side plane view of a clamping element along line 3A—3A in FIG. 3.

Each fastening device is adapted to hold a single screwdriver and is composed of a clamping element (30) and a supporting element (40). The supporting element (40) is a U-shaped frame (not numbered) with an end face (not numbered), an opening (not numbered) and two opposite sides closely meeting with a handle neck of the screwdriver, and is formed near a side edge of the base (10) such that the opening is close to the side edge. The U-shaped frame has an inward portion formed at each opposite side to further closely mate with the outlines of the handle neck of the screwdriver and to avoid the screwdriver sliding out horizontally. A cutout (42) is formed in the end face of the U-shaped frame for resting a shaft of the screwdriver thereon. The clamping element (30) is formed on the base (10) and is composed of two arms (32) erecting on the base (10) to construct a channel (not numbered) between the two arms (32). The channel is aligned to the cutout (42). Each arm (32) has an inner lip (322) at a distal end thereof and a distance between the lips (322) is smaller than an outer diameter of the shaft of the screwdriver to firmly clamp the screwdriver in the channel once the shaft has been urged through the lips (322) as shown in FIG. 3A. Additionally, each fastening device further comprises a loop (50) formed on the base (10). The loop (50) has a through hole (52) aligning to the channel of the clamping element (30) and the cutout (42) on the supporting element (40) and adapted to hold a tail end of the shaft of the screwdriver as shown in FIG. 3B. Moreover, the loop (50) further has a bottom and a dent (not shown) formed on the bottom to adapt to closely meet sharp angles of some angular shafts. By holding the tail end of the shaft with the loop (50), the screwdriver is not easily swung and can be kept steady on the tool suspension plate.

Figure 9:
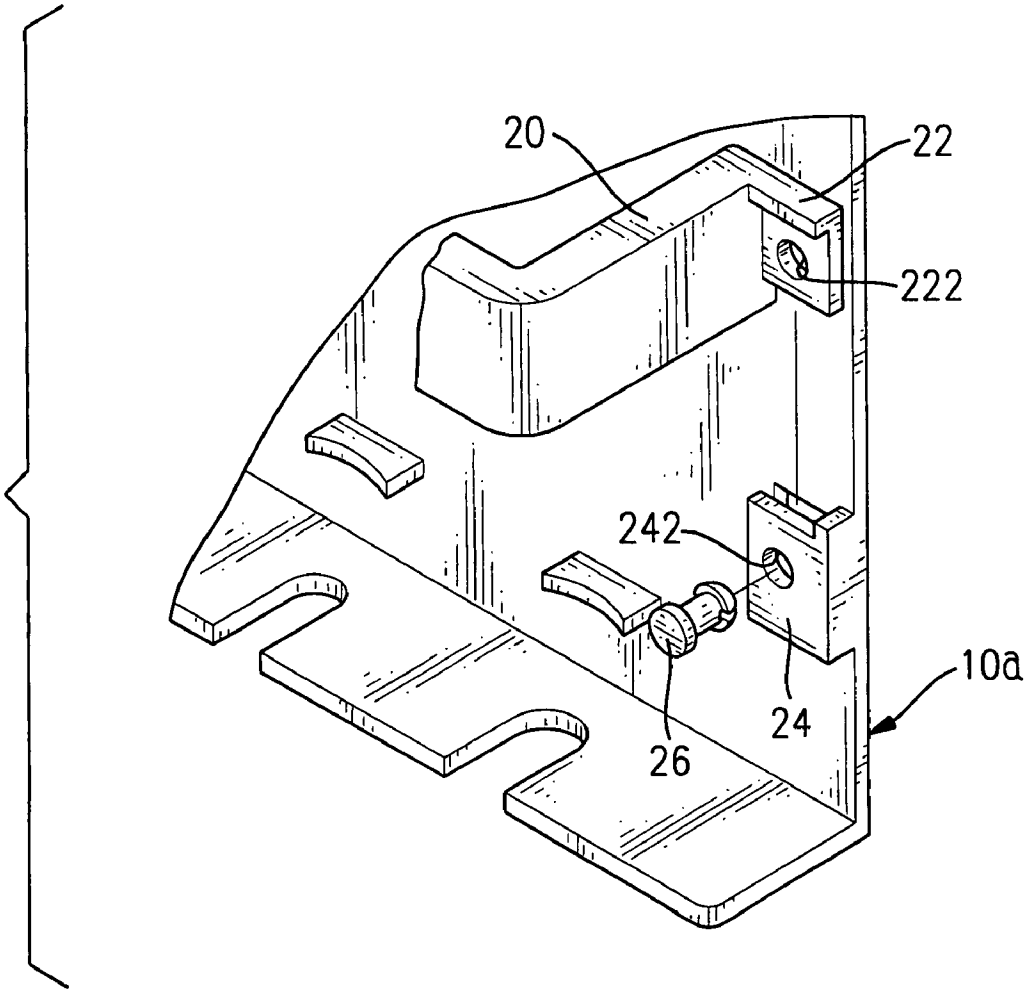
FIG. 9 is a partially enlarged exploded view of a fastening means between a plate and a thief-proof slat of the tool suspension plate.
Figure 10:
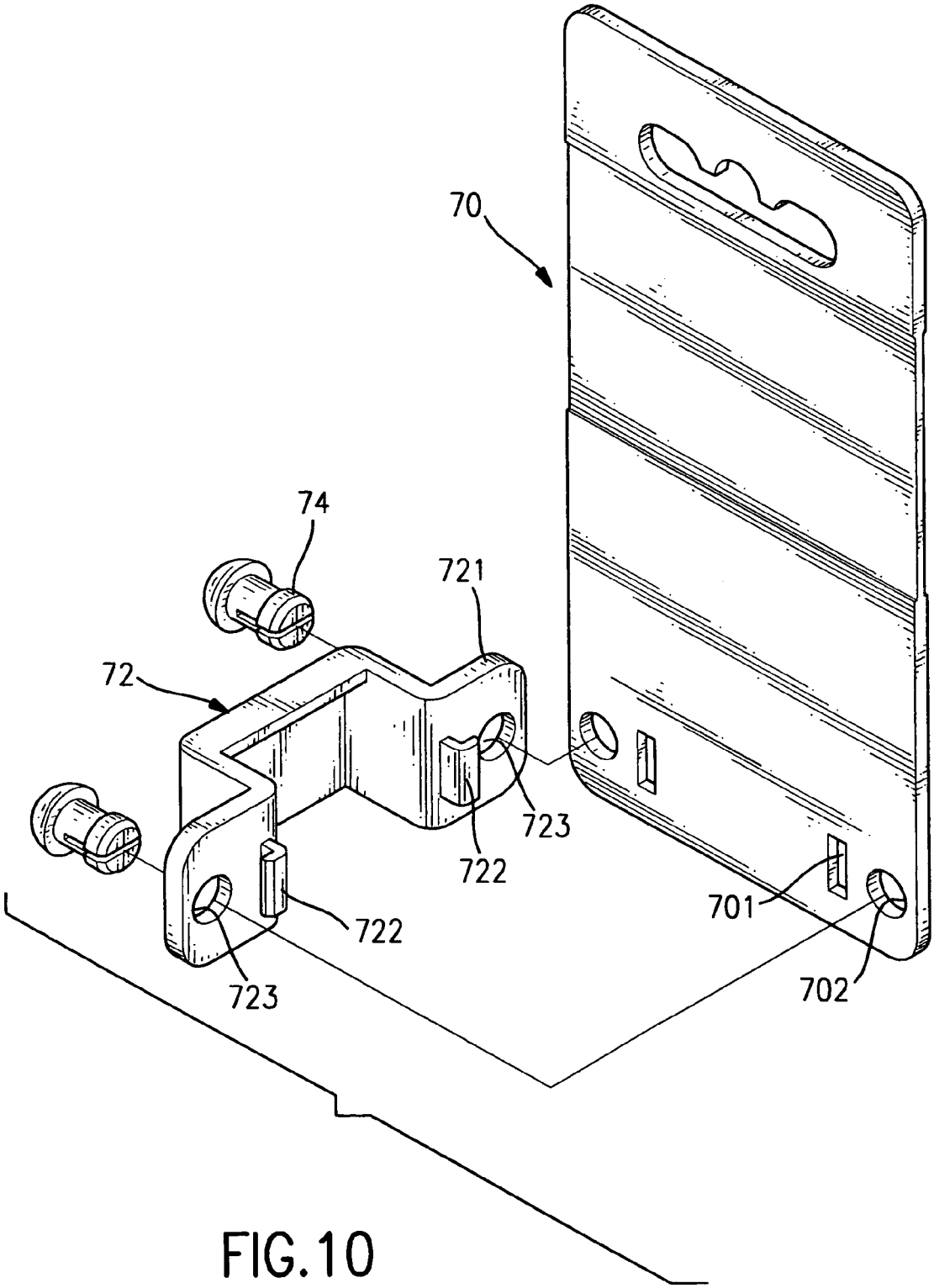
FIG.10 PRIOR ART
FIG. 10 is an exploded perspective view of a conventional tool suspension rack for a wrench in accordance with the prior art.
Figure 11:
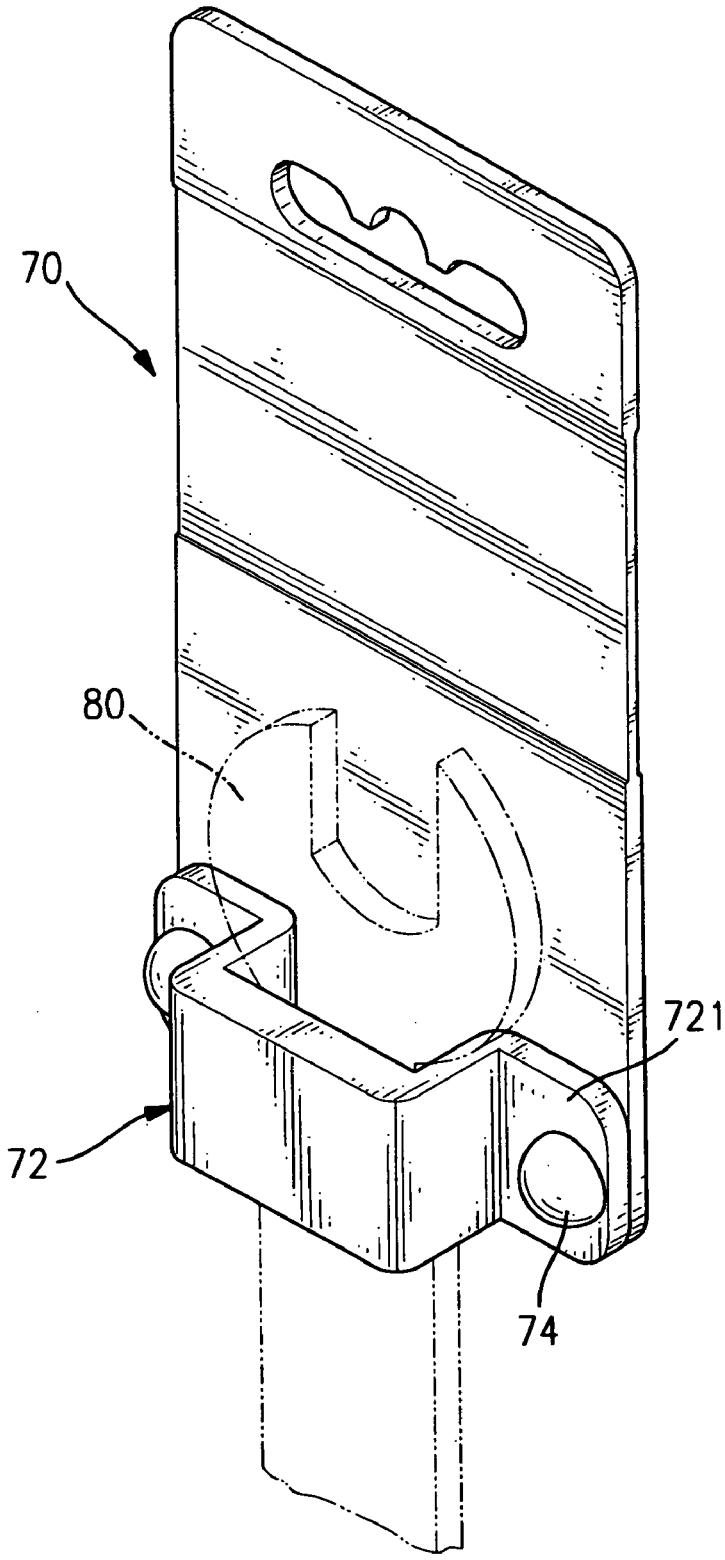
FIG.11 PRIOR ART
FIG. 11 is a perspective view of the conventional tool suspension rack, wherein the conventional tool suspension rack is assembled.

The slat (20) longitudinally crosses the multiple fastening devices and is basically a U-shaped bracket with two ends. A locking sheet (22) is formed on each end of the U-shaped bracket and has a hole (222) defined in the locking sheet (22). With further reference to FIG. 9, two end brackets (24) are formed at two side edges of the base (10) to engage with the corresponding locking sheet (22). Each end bracket (24) is an L-shaped frame on the base (10) and has a short plate (not numbered), a long plate (not numbered), and a locking hole (242) defined in the long plate to align with the hole (222) on the locking sheet (22). The short plate of the L-shaped frame abuts the base (10) at edge and the long plate of the L-shaped frame is parallel with the base (10) and extending inward. Thereby, a slit (not numbered) is constructed between the long plate and the base (10) for accommodating the locking sheet (22). When the locking sheet (22) is inserted in the slit, a locking pin (26) penetrates the locking hole (242) of each end bracket (24) and the hole (222) on each corresponding locking sheet (22) to fasten the slat (20) on the base (10). Preferably, the slat (20) is attached on the base to cross over handles of the screwdrivers.

Figure 4:
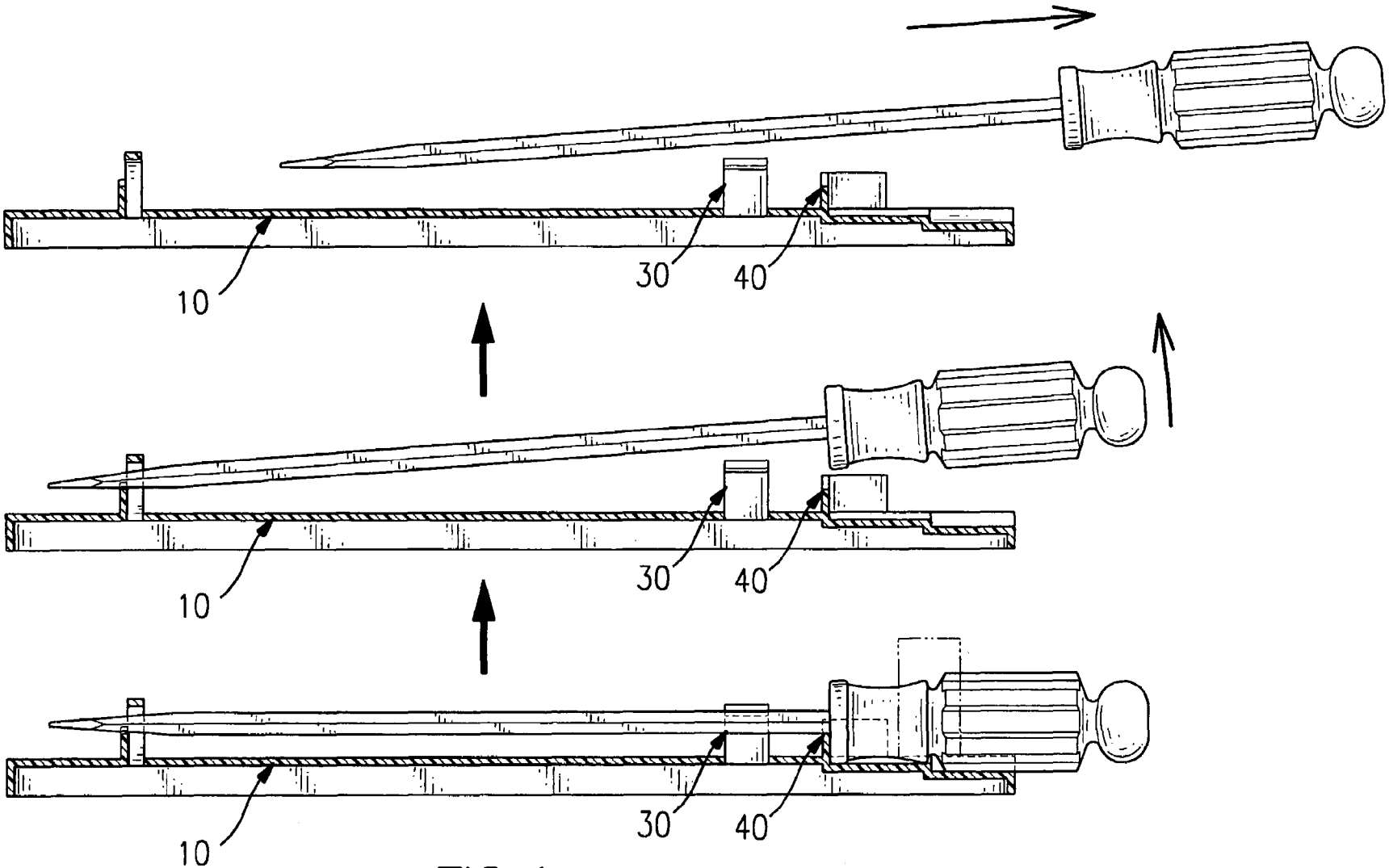
FIG. 4 is an operational side plane view of detaching a screwdriver from the tool suspension plate.

With reference to FIG. 4, when the screwdriver is to be detached from the tool suspension plate, the slat (20) is detached from the base (10) first. Then, the screwdriver horizontally swung out away from the base (10) to separate the handle from the supporting element (40) until the shaft is also detached from the clamping element (30). Lastly, the screwdriver is horizontally pulled outward to make shaft completely separate from the loop (50).

Figure 5:
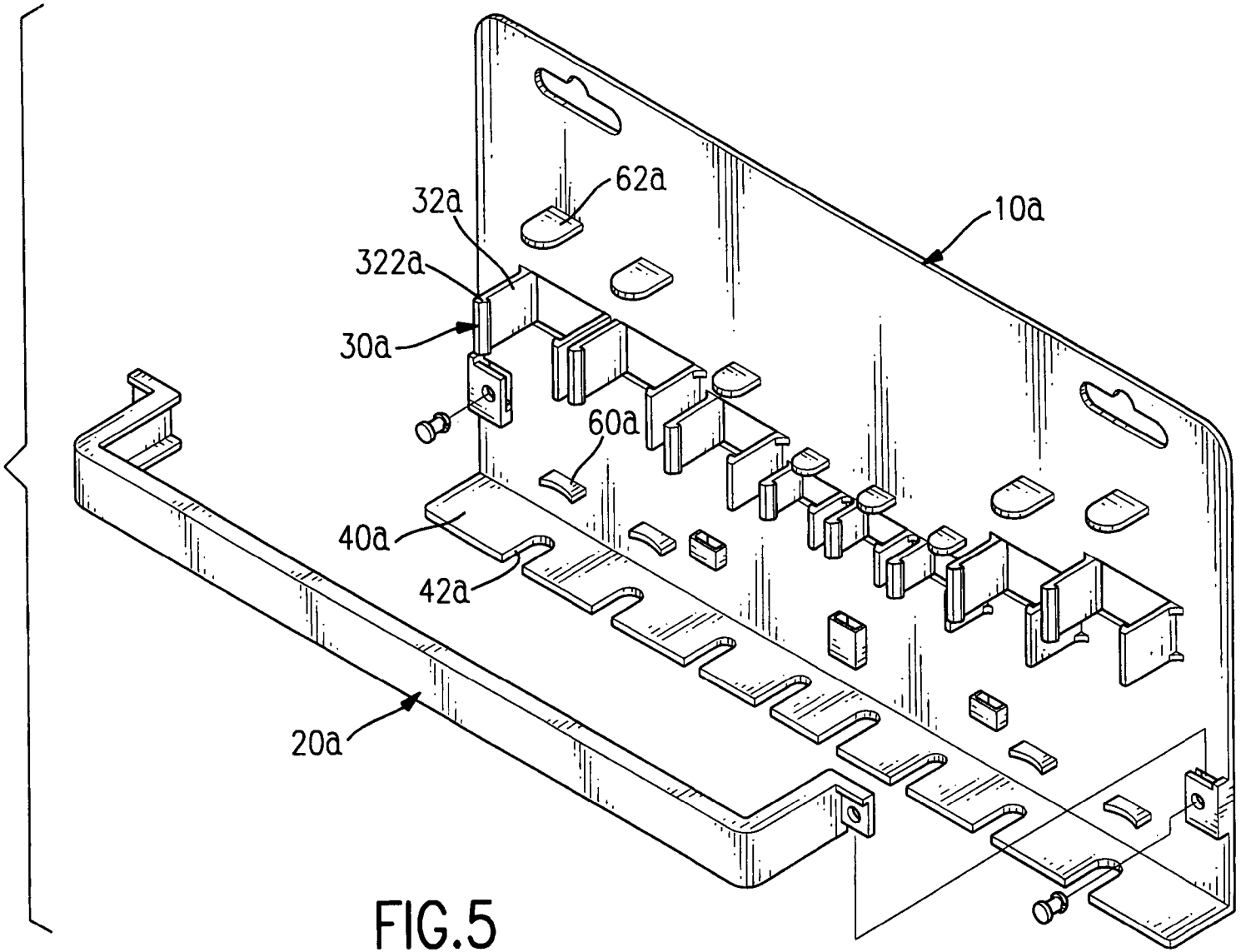
FIG. 5 is an exploded perspective view of a second embodiment of the tool suspension plate.
Figure 6:
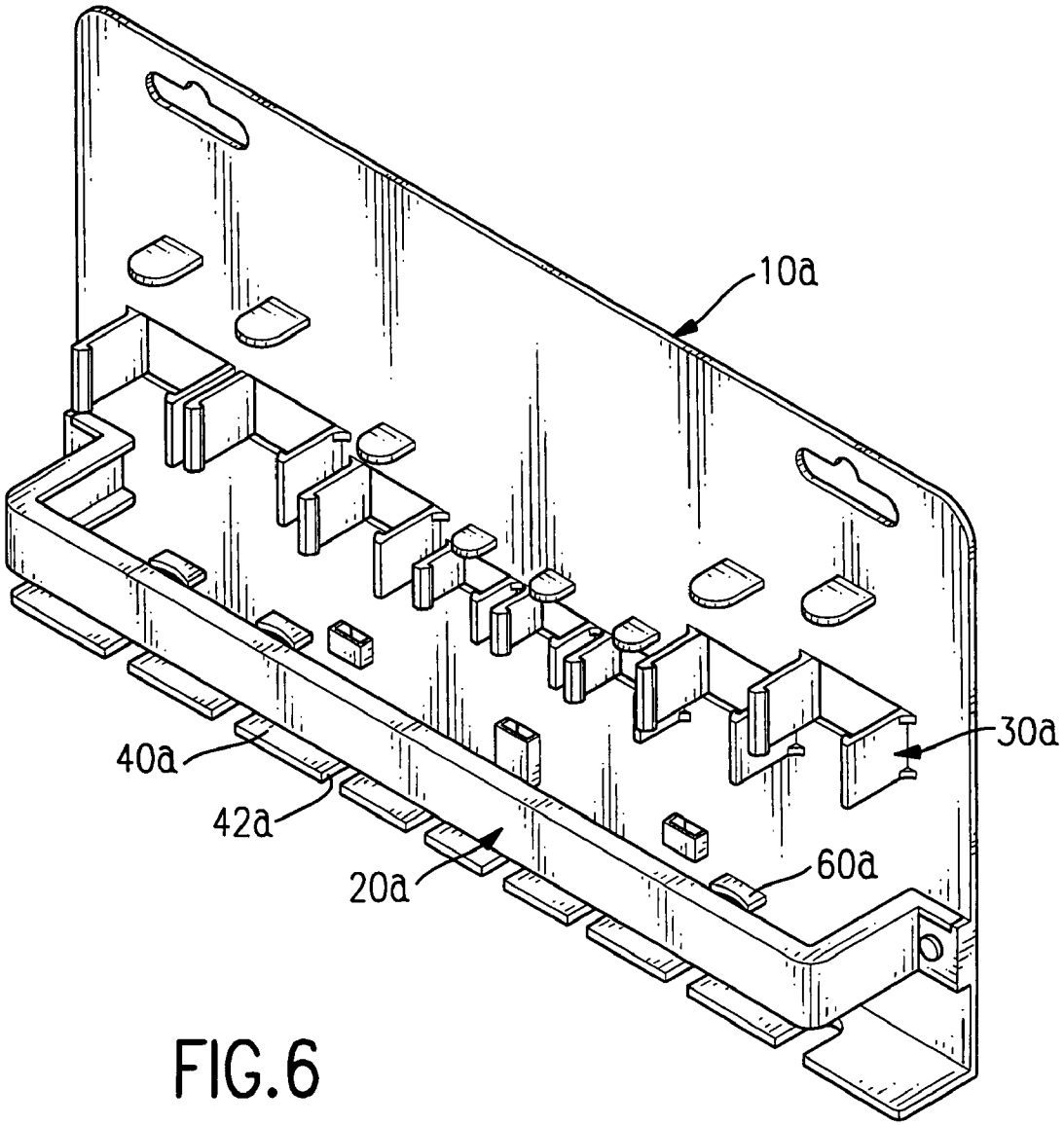
FIG. 6 is a perspective view of the second embodiment of the tool suspension plate in accordance with FIG. 5, wherein the tool suspension plate is assembled.
Figure 7:
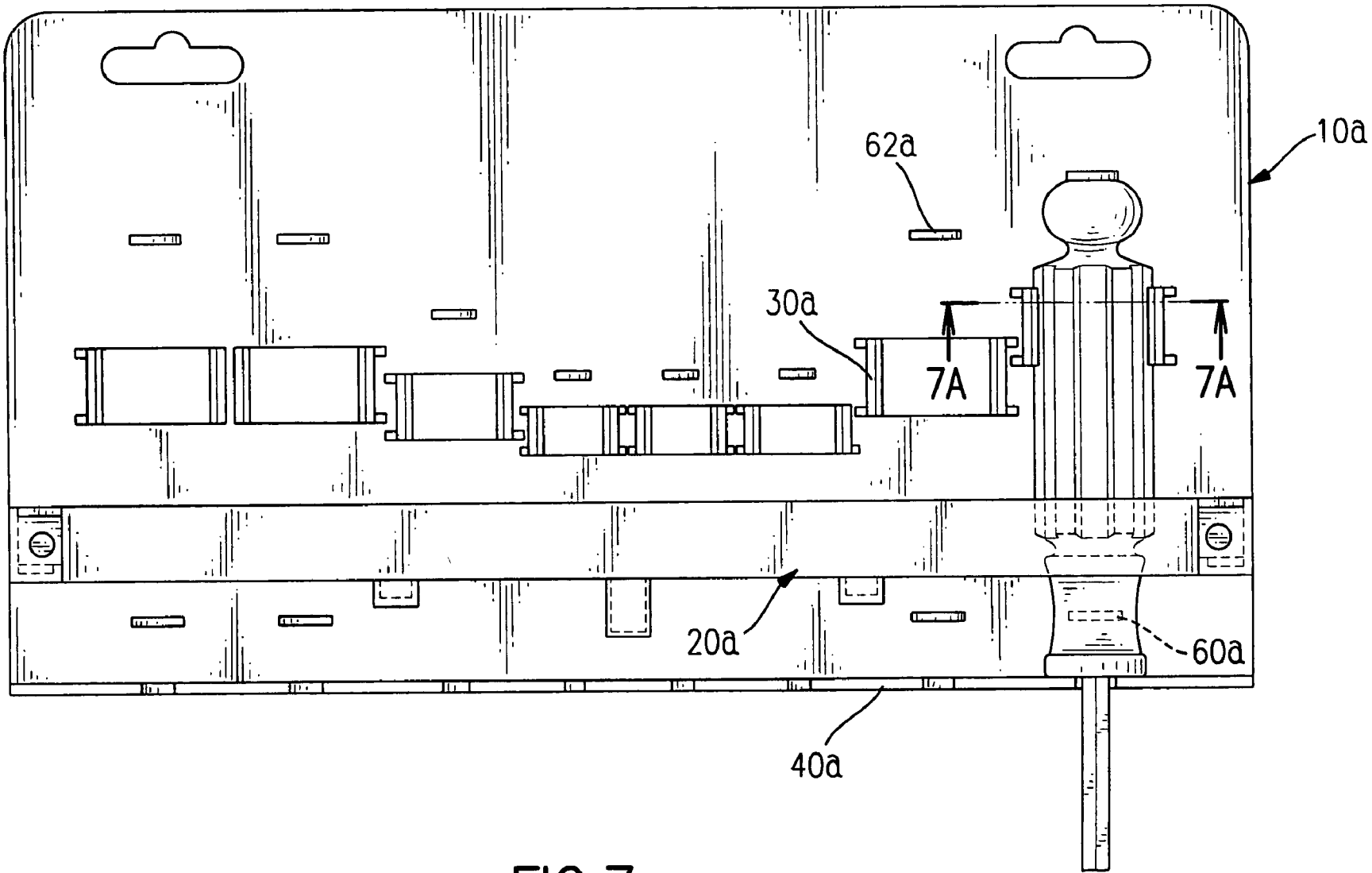
FIG. 7 is a side plane view of the second embodiment of the tool suspension plate, wherein a screwdriver is mounted on the tool suspension plate.

With reference to FIGS. 5 and 7, a second embodiment of the tool suspension plate has the screwdriver set placed vertically and arranged one by one in transversal direction. The second embodiment of the tool suspension plate comprises a base (10*a*) with a flange (not numbered), multiple fastening devices (not numbered) formed on then base (10*a*), and a slat (20*a*) detachably mounted on the base (10*a*) and crossing the multiple fastening device.

Figure 7A:
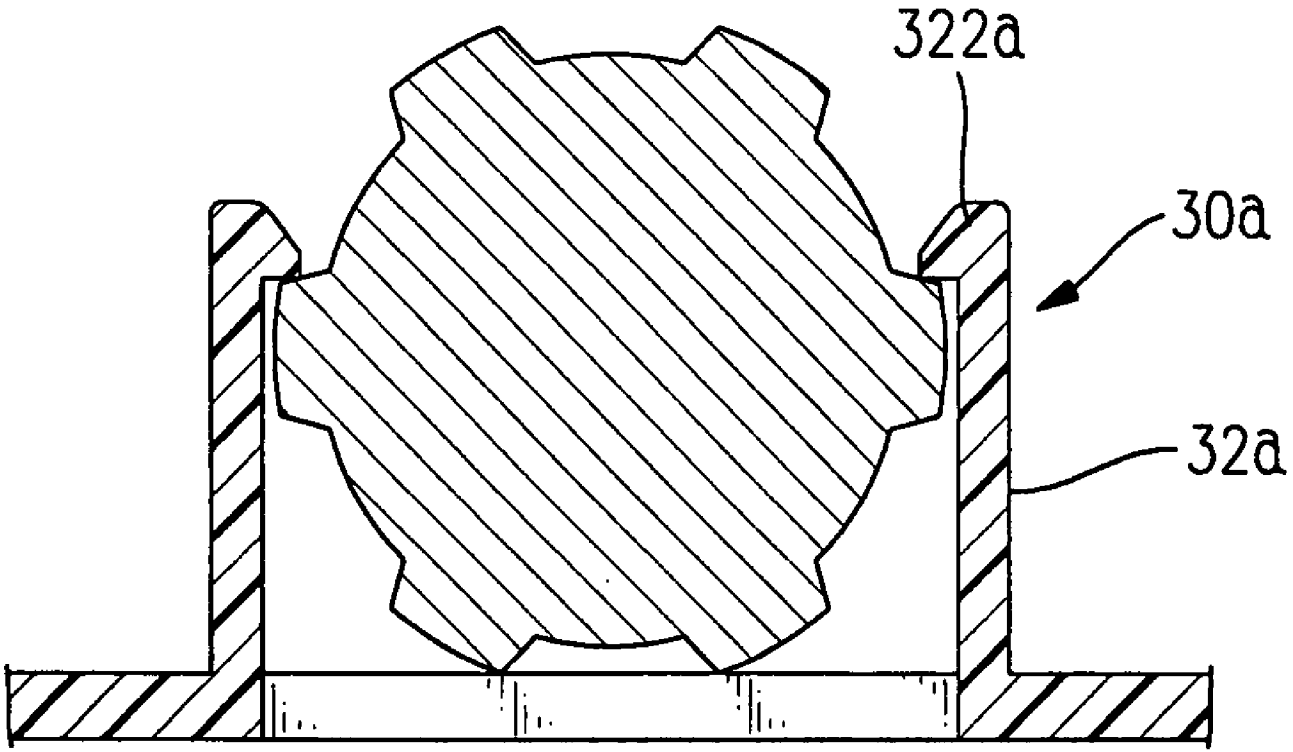
FIG. 7A is a cross-sectional side plane view of the clamping element along line 7A—7A in FIG. 7.

Each fastening device is adapted to hold a single screwdriver and is composed of a clamping element (30*a*) and a supporting element (40*a*). The supporting element (40*a*) is performed by the flange with multiple recess (42*a*) defined in the flange. When the screwdriver mounted on the tool suspension plate, a shaft of the screwdriver penetrates one corresponding recess (42*a*) and a handle of the screwdriver is rest on the supporting element (40*a*). The clamping element (30*a*) is formed above the supporting element (40*a*) on the base (10*a*) and is composed of two arms (32*a*) erecting on the base (10*a*) to construct a channel (not numbered) between the two arms (32*a*). The channel is aligned to the recess (42*a*). With further reference to FIG. 7A, each arm (32*a*) has an inner lip (322*a*) at a distal end thereof and a distance between the lips (322*a*) is smaller than an outer diameter of the handle of the screwdriver to firmly clamp the screwdriver in the channel once the shaft has been urged through the lips (322*a*). Additionally, each fastening device further comprises a positioning rest (60*a*) formed between the clamping element (30*a*) and the supporting element (40*a*) on the base (10*a*). The positioning rest (60*a*) has a distal end and a curved face (not numbered) formed on the distal end for resting a handle neck of the screwdriver to provide an additional positioning efficiency.

The slat (20*a*) transversally crosses the multiple fastening devices and has the same configuration and engaging means to the base (10*a*) with the one described in the first embodiment. Therefore, redundant description of the slat (20*a*) is obviated here. However, the supporting element (40*a*) has no locking efficiency to avoid the screwdriver from pulling along the base (10*a*) as the inward portion of the U-shaped frame does. Therefore, a stop plate (62*a*) is formed above the clamping element (30*a*) to abut a handle top of the screwdriver to avoid the screwdriver pulling upward and out along the base (10*a*).

Figure 8:
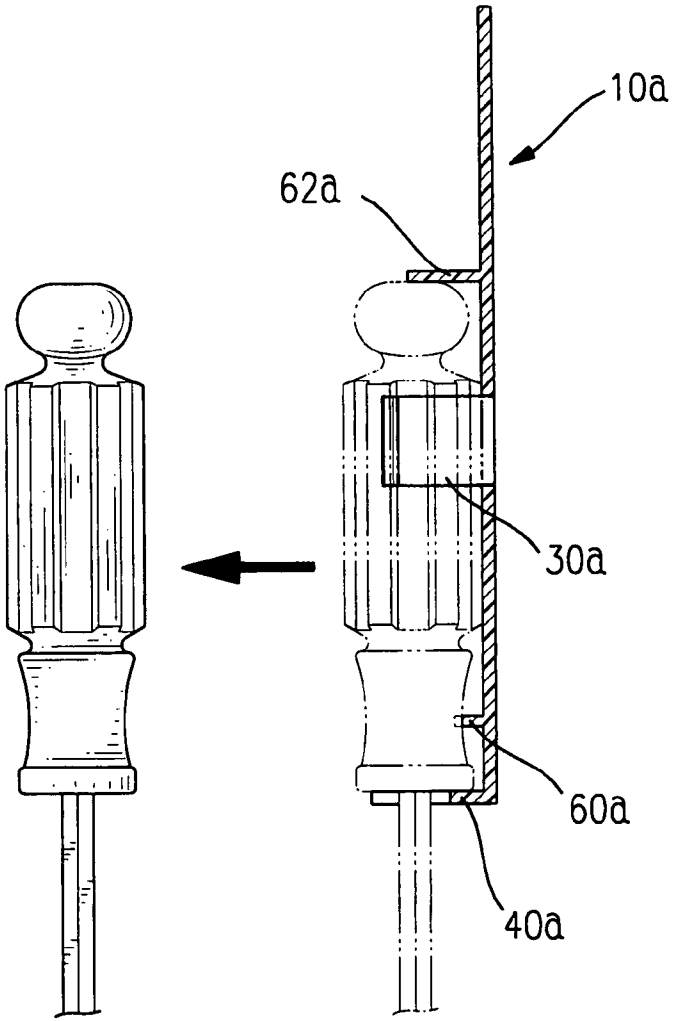
FIG. 8 is an operational cross-sectional side plane view of detaching the screwdriver from the tool suspension plate.

With reference to FIG. 8, when the screwdriver is to be detached from the tool suspension plate, the slat (20*a*) is detached from the base (10) first. Then, the screwdriver is pushed out to separate the handle from the clamping element (30*a*) and the supporting element (40*a*). Thereby, the screwdriver is completely separated from the tool suspension plate.

According to the foregoing description, the clamping element firmly clamps parts of the screwdriver and the supporting element supports the handle of the screwdriver. By both elements, each screwdriver in the screwdriver set enables to be firmly and stably held on the tool suspension plate. Further in cooperation with the slat, the tool suspension plate has a thief-proof efficiency to demonstrate the screwdriver set in a safe way.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension plate comprising:

a base;

at least one fastening device formed on the base; and a slat detachably mounted on the base and crossed over the at lease one fastening device;

wherein each fastening device comprises a clamping element and a supporting element, the clamping element is adapted to clamp a part of a screwdriver and the supporting element is adapted to support a handle of the screwdriver, wherein each supporting element is a U-shaped frame with an end face, an opening and two opposite sides and has an inward portion formed on each of opposite sides to adapt to closely meet an outline of the handle, and a cutout defined on the end face to adapt to receive a shaft of the screwdriver on the U-shaped frame.

2. The tool suspension plate as claimed in claim 1, wherein each clamping element comprises two arms erecting on the base in parallel to construct a channel between the two arms; and each arm has a distal end and an inner lip formed at the distal end within the channel.

3. The tool suspension plate as claimed in claim 1, wherein each clamping element comprises two arms erecting on the base in parallel to construct a channel between the two arms to align to the cutout in a corresponding supporting element; and each arm has a distal end and an inner lip formed at the distal end within the channel.

4. The tool suspension plate as claimed in claim 3, wherein each fastening device further comprises:

a loop with a through hole formed on the base, wherein the through hole aligns to the channel and the cutout and is adapted to receive a tail end of the shaft of the screwdriver.

5. The tool suspension plate as claimed in claim 4, wherein the slat is a U-shaped bracket with two ends and has a locking sheet formed on each end of the slat;

each locking sheet has a hole defined through the locking sheet; and two end brackets are formed on the base to respectively engage with the locking sheets, wherein each end bracket has a locking hole defined in the bracket to align with the hole in a corresponding one of the locking sheets to engage with the locking sheet by means of a locking pin.

6. The tool suspension plate as claimed in claim 1, wherein the slat is a U-shaped bracket with two ends and has a locking sheet formed on each end of the slat;

each locking sheet has a hole defined through the locking sheet; and two end brackets are formed on the base to respectively engage with the locking sheets, wherein each end bracket has a locking hole defined in the bracket to align with the hole in a corresponding one of the locking sheets to engage with the locking sheet by means of a locking pin.

7. A tool suspension plate comprising:

a base;

at least one fastening device formed on the base; and a slat detachably mounted on the base and crossed over the at lease one fastening device;

wherein each fastening device comprises a clamping element and a supporting element, the clamping element is adapted to clamp a part of a screwdriver and the supporting element is adapted to support a handle of the screwdriver, wherein the slat is a U-shaped bracket with two ends and has a locking sheet formed on each end of the slat;

each locking sheet has a hole defined through the locking sheet; and two end brackets are formed on the base to respectively engage with the locking sheets, wherein each end bracket has a locking hole defined in the bracket to align with the hole in a corresponding one of the locking sheets to engage with the locking sheet by means of a locking pin.

8. The tool suspension plate as claimed in claim 7, wherein each supporting element is a U-shaped frame with an end face, an opening and two opposite sides and has an inward portion formed on each of opposite sides to adapt to closely meet an outline of the handle, and a cutout defined on the end face to adapt to receive a shaft of the screwdriver on the U-shaped frame.

9. The tool suspension plate as claimed in claim 8, wherein each clamping element comprises two arms erecting on the base in parallel to construct a channel between the two arms; and each arm has a distal end and an inner lip formed at the distal end within the channel.

10. The tool suspension plate as claimed in claim 9, wherein each clamping element comprises two arms erecting on the base in parallel to construct a channel between the two arms to align to the cutout in a corresponding supporting element; and each arm has a distal end and an inner lip formed at the distal end within the channel.

11. The tool suspension plate as claimed in claim 10, wherein each fastening device further comprises:

a loop with a through hole formed on the base, wherein the through hole aligns to the channel and the cutout and is adapted to receive a tail end of the shaft of the screwdriver.

12. The tool suspension plate as claimed in claim 11, wherein the slat is a U-shaped bracket with two ends and has a locking sheet formed on each end of the slat;

each locking sheet has a hole defined through the locking sheet; and two end brackets are formed on the base to respectively engage with the locking sheets, wherein each end bracket has a locking hole defined in the bracket to align with the hole in a corresponding one of the locking sheets to engage with the locking sheet by means of a locking pin.

* * * * *